US009446884B2

(12) United States Patent
McGinley

(10) Patent No.: US 9,446,884 B2
(45) Date of Patent: Sep. 20, 2016

(54) FLEXIBLE PANEL PITCHER

(71) Applicant: Michael L. McGinley, Prairie Village, KS (US)

(72) Inventor: Michael L. McGinley, Prairie Village, KS (US)

( * ) Notice: Subject to any disclaimer, the term of this patent is extended or adjusted under 35 U.S.C. 154(b) by 21 days.

(21) Appl. No.: 14/163,320

(22) Filed: Jan. 24, 2014

(65) Prior Publication Data

US 2014/0175134 A1 Jun. 26, 2014

Related U.S. Application Data

(63) Continuation-in-part of application No. 12/255,797, filed on Oct. 22, 2008, now Pat. No. 8,636,178, which is a continuation-in-part of application No. 10/770,325, filed on Feb. 2, 2004, now Pat. No. 7,441,675, and a continuation-in-part of application No. 10/357,651, filed on Feb. 4, 2003, now abandoned.

(51) Int. Cl.

| | |
|---|---|
| ***A47G 19/14*** | (2006.01) |
| ***B65D 35/08*** | (2006.01) |
| ***A47G 19/12*** | (2006.01) |
| ***A45D 19/00*** | (2006.01) |
| ***A45D 19/02*** | (2006.01) |
| ***A45D 19/06*** | (2006.01) |
| ***A45D 19/04*** | (2006.01) |
| *A45D 44/12* | (2006.01) |

(52) U.S. Cl.

CPC ..... *B65D 35/08* (2013.01); *A45D 19/00* (2013.01); *A45D 19/02* (2013.01); *A45D 19/04* (2013.01); *A45D 19/06* (2013.01); *A47G 19/12* (2013.01); *A45D 44/12* (2013.01); *A45D 2019/0058* (2013.01)

(58) Field of Classification Search

CPC ..... B65D 35/08; B65D 25/04; B65D 25/42; B65D 35/10; B65D 35/22; A45D 19/00; A45D 19/02; A45D 19/04; A45D 19/06; A45D 19/08; A45D 19/14; A45D 44/12; A45D 34/04; A45D 2019/0058; A47G 19/12; A47G 19/2211; Y10S 220/904

USPC ..... 222/215, 210, 574, 573, 572, 94, 465.1; 4/515; 68/233; 215/400; 220/904, 561, 220/9.3, 666, 834, 555

See application file for complete search history.

(56) References Cited

U.S. PATENT DOCUMENTS

| | | | | |
|---|---|---|---|---|
| 33,737 | A | | 11/1861 | Fitts |
| 1,225,511 | A | | 5/1917 | Sexton |
| 1,439,180 | A | * | 12/1922 | Magovern ..... 383/29 |
| 2,333,014 | A | | 10/1943 | Kennedy |
| 2,610,490 | A | | 9/1952 | Tupper |
| 2,872,081 | A | | 2/1959 | Randall |
| 3,178,854 | A | * | 4/1965 | Barron, Jr. ..... 47/11 |
| 3,729,553 | A | | 4/1973 | Gold et al. |
| 4,609,113 | A | | 9/1986 | Seki |
| 4,756,439 | A | | 7/1988 | Perock |
| 4,886,206 | A | | 12/1989 | Martinez |
| 4,955,503 | A | | 9/1990 | Propes |

(Continued)

*Primary Examiner* — Patrick M Buechner

(74) *Attorney, Agent, or Firm* — Law Office of John C. McMahon

(57) ABSTRACT

A container or pitcher having a flexible side wall portion and rim portion of the container which can conform to the shape of an object to which the pitcher is applied to thereby direct fluid flow from the pitcher over a broader area and to prevent fluid from flowing from the pitcher and underneath the rim of the pitcher and onto portions of the object to which it is not desirable to apply the fluid.

9 Claims, 8 Drawing Sheets

(56) References Cited

U.S. PATENT DOCUMENTS

| | | | | |
|---|---|---|---|---|
| 5,415,305 | A | 5/1995 | Drake-Tipton et al. | |
| 5,507,431 | A | 4/1996 | Bertone | |
| 5,711,445 | A * | 1/1998 | Robbins, III | 220/8 |
| RE35,933 | E | 10/1998 | Scholl | |
| 5,950,834 | A | 9/1999 | Woodnorth et al. | |
| 5,960,987 | A | 10/1999 | Solland et al. | |
| 6,138,963 | A * | 10/2000 | Malvasio | 248/111 |
| 6,241,388 | B1 | 6/2001 | Terramani | |
| 6,470,705 | B2 | 10/2002 | Bride-Flynn | |
| 6,605,342 | B1 * | 8/2003 | Burghaus | B32B 27/08 428/201 |
| 6,708,838 | B2 | 3/2004 | Bergman et al. | |
| 7,441,675 | B2 | 10/2008 | McGinley et al. | |
| 7,757,895 | B2 | 7/2010 | McGinley et al. | |
| 7,988,011 | B1 | 8/2011 | Guevara | |
| 8,087,595 | B1 * | 1/2012 | Freese | 239/377 |
| 8,444,022 | B2 | 5/2013 | Holcomb et al. | |
| 8,636,178 | B2 * | 1/2014 | McGinley et al. | 222/210 |
| 2004/0149783 | A1 * | 8/2004 | McGinley | 222/465.1 |
| 2004/0155070 | A1 * | 8/2004 | McGinley et al. | 222/465.1 |
| 2009/0032551 | A1 * | 2/2009 | McGinley et al. | 222/129 |
| 2009/0045229 | A1 * | 2/2009 | McGinley et al. | 222/465.1 |

* cited by examiner

Fig. 14.
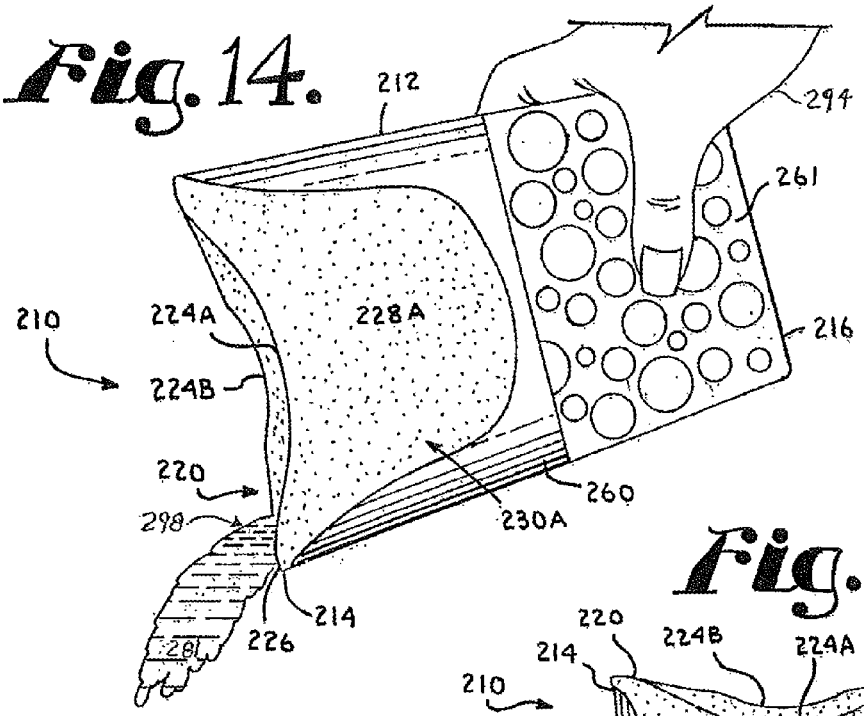
Fig. 15.
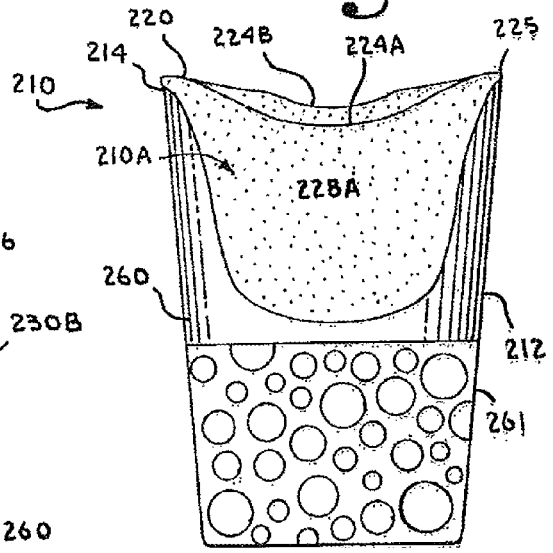
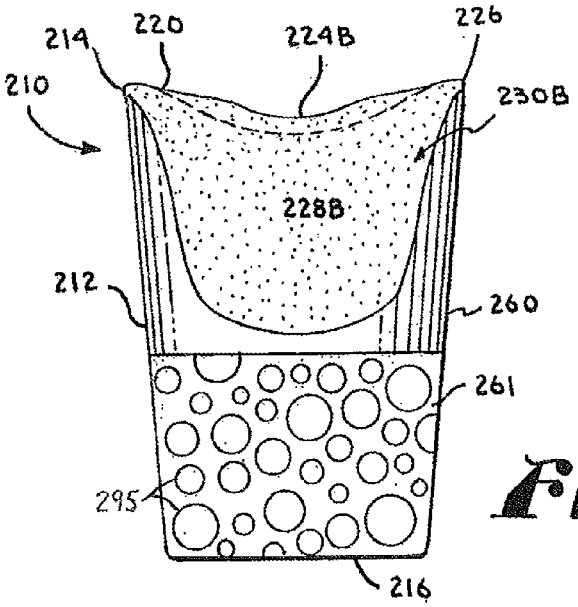
Fig. 16.

FLEXIBLE PANEL PITCHER

CONTINUATION DATA

This is a continuation-in-part of application Ser. No. 12/255,797, now U.S. Pat. No. 8,636,178, which was a continuation-in-part of Ser. No. 10/770,325 filed Feb. 2, 2004, now U.S. Pat. No. 7,441,675, and which was a continuation-in-part of application Ser. No. 10/357,651 filed Feb. 4, 2003, all applications mentioned are incorporated by reference.

FIELD OF THE INVENTION

The present invention relates to containers, specifically containers used to hold fluids and, in particular, a container having a flexible side wall portion and rim portion which is capable of conforming to the shape of an object to which the pitcher is applied to more particularly direct the flow of fluid from the pitcher and to prevent the flow of fluid from the pitcher and onto areas to which application of the fluid is not intended.

BACKGROUND OF THE INVENTION

When using pitchers to pour fluids, it is frequently desired to pour a stream of the fluid into a specific location, such as a glass or other container. Alternatively, it may be useful to use a container or a pitcher that does not provide an actual spout, but rather, simply has a rim when it is desired to pour a greater amount of fluid or broader stream of fluid onto an object such as when rinsing a floor or an automobile. However, both of these types of containers and pouring operations present specific drawbacks to particular applications. For example, when using a pitcher having a spout, the fluid that is poured from the pitcher can only be applied to a particular area, specifically, that area determined by the stream of fluid as it exits the spout. While this is useful for pouring water into a glass, another container or a specific area, it is not useful for applying the fluid to a larger area. Also, the use of a spout while narrowing the stream of water, nevertheless, provides a narrow column-like stream of water which, when it contacts the object or container toward which it is directed, will flow in all directions.

The other case of pouring a fluid from a container—that is the case of a bucket or other broad-rimmed container—also presents limitations with respect to the pouring of a fluid. In the case of a bucket or a pitcher having no spout, the water will flow from the pitcher over the rim or edge of the pitcher and create a broad stream of fluid flowing from the pitcher which will be related to the angle of the longitudinal axis of the pitcher as it moves from vertical to horizontal. To state the obvious, when the longitudinal axis of the pitcher (that is the axis passing through the bottom of the pitcher and the top of the pitcher) is parallel to vertical, no fluid will flow from the pitcher. As the longitudinal axis is tilted increasingly toward a horizontal plane, more and more fluid will flow over the rim of the pitcher, and the stream flowing from the pitcher will be increasingly wide. While such a spoutless pitcher, such as a bucket, provides a wide stream of fluid which is useful in, for example, rinsing an area, there is still no control over the distribution of that stream over the object on which it is poured. Specifically, if a stream of water is poured from a bucket, when the stream of water contacts the object on which it is poured, the water will flow in all directions and will not be limited to a single direction of flow. Even if the rim of the pitcher is pressed directly against—the object onto which the fluid is to flow, the fluid will flow back toward the pitcher and underneath the pitcher and onto portions of the object which are near the side wall of the pitcher.

In the specific case of rinsing shampoo and other hair treatments from the head of a child, this "backflow" from a pitcher can provide compelling support for the Victorian premise that children should be seen and not heard. Specifically, the backflow of rinse water from a pitcher that is used to dip bath water and to lift it to rinse the head of a child can cause shampoo and other hair and scalp treatments to flow down the forehead of the child and into the eyes and face of the child. This will cause the child to notify the parent of the situation through loud screams, tears and arm movements. The prospect of rinsing soap suds into the eyes and mouth and nose of a child is not pleasant for either the parent or the child and can lead to difficulties as bath time approaches. Usually it is the case that the best of attempts to try to limit this problem are unsuccessful. Asking the child to close his or her eyes tightly while the rinsing is proceeding will be only partially successful. The child, for one reason or another, may open their eyes during the rinsing procedure whereupon the soapy water contacts and stings their eyes. Alternatively, the child may improperly time the closing of their eyes with the application of the rinse water and receive a stinging realization of their incapacity to coordinate their eyelid movements. Even should the parent attempt to assist the situation by placing a hand across the forehead of the child, some soapy water will inevitably trickle down the forehead of the child and into the child's eyes, mouth or nose.

Therefore, it would be a great benefit if a rinse container or pitcher could be provided which would prevent the flow of rinse water from a rinse pitcher or container and back underneath the rim of the container thereby providing specific, directional application of rinse water to an object such as a child's head.

Yet another benefit would be obtained from a pitcher or rinse container which could provide a broad flow of rinse water to an object to more efficiently rinse the object and while providing means for directing the flow of the rinse water from the pitcher and onto the object while preventing the backflow of rinse water onto areas of the object to which rinse water is not intended to be applied.

It would still be a further benefit if such a pitcher or rinsing container could conform to the shape of the object to which the rinse water in the pitcher was to be applied thereby restricting the portions of the object which will receive rinse water from those portions of the object which will not receive rinse water. These objects and benefits and more are provided by the present invention which is more completely described hereinafter.

SUMMARY OF THE INVENTION

The present invention solves the preceding problems and improves the state of the art by providing a pitcher for holding solutions such as rinse water or shampoo or other liquids to allow application of those liquids to a localized portion of the body such as the head. The present invention provides a flexible panel and/or flexible rim portion of the container which conforms to the shape of the an object, such as the head of an individual, to allow application of the fluid to the body and to prevent misapplication of the fluid by preventing fluid from flowing underneath the rim and onto body parts to which it is not desired to apply the fluid.

In one embodiment, the invention provides a flexible panel which can conform to the shape of the child's head or other object to effectively seal off passage of fluids back under the flexible rim thereby allowing application of the fluid, such as rinse water, to the child's hair while preventing the flow of rinse water and a rinse water-shampoo mixture down into the child's face and eyes.

In another embodiment a divider panel is provided within the container to provide a second source of fluid flow onto the object to which the container is applied to provide a source of flow that is not partially deflected from the object by the deflection of the flexible panel as it conforms to the shape of the child's head or other object to which the flexible panel is applied.

These other objects are intended to be illustrative of the invention and are not meant in a limiting sense. Many possible embodiments of the invention may be made and will be evident upon a study of the following specification and accompanying drawings. Various features and subcombinations of invention may be employed without reference to other features and subcombinations. Other objects and advantages of this invention will become apparent from the following description and drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

FIG. 14 is a side view of the pitcher in FIG. 10 in an alternate application of the invention to use a shorter side of the pitcher to allow water to flow out in a more directed stream.

FIG. 15 is a side view of the pitcher of FIG. 10 showing the larger rim flexible panel side.

FIG. 16 is a side view of the pitcher in FIG. 10 showing the smaller rim flexible panel side.

DESCRIPTION OF THE PREFERRED EMBODIMENT

As required, detailed embodiments of the present inventions are disclosed herein; however, it is to be understood that the disclosed embodiments are merely exemplary of the invention, which may be embodied in various forms. Therefore, is specific structural and functional details disclosed herein are not to be interpreted as limiting, but merely as a basis for the claims and as a representative basis for teaching one skilled in the art to variously employ the present invention in virtually any appropriately detailed structure.

Figure 1:
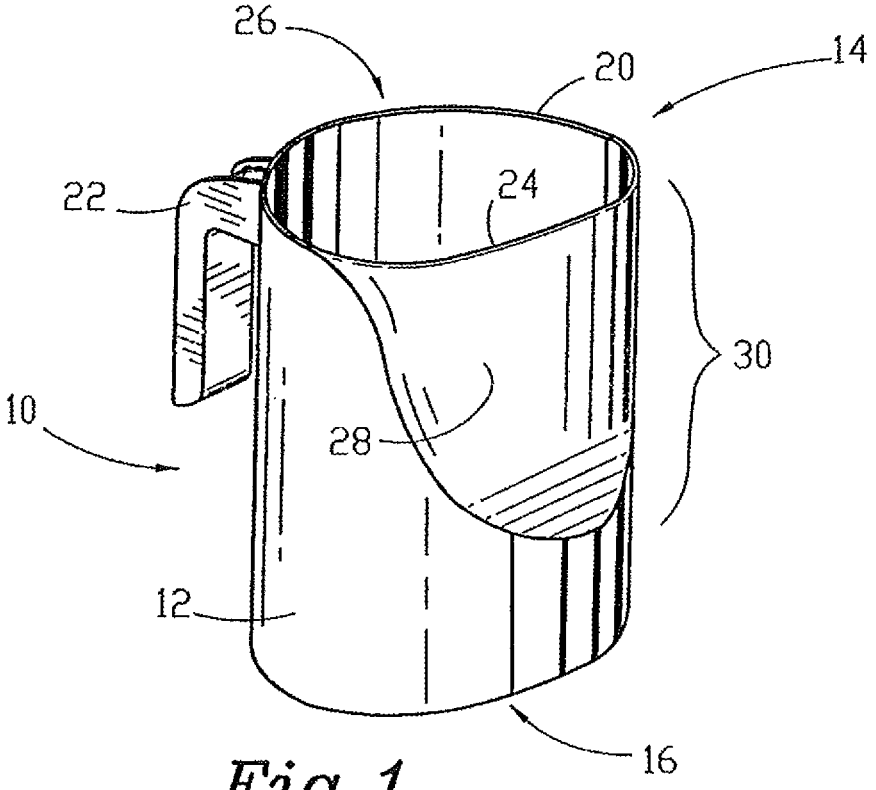
FIG. 1 is a top and side perspective view of the pitcher of the present invention showing the flexible panel which comprises a portion of the side wall of the container and the top edge of the side wall of the container.
Figure 2:
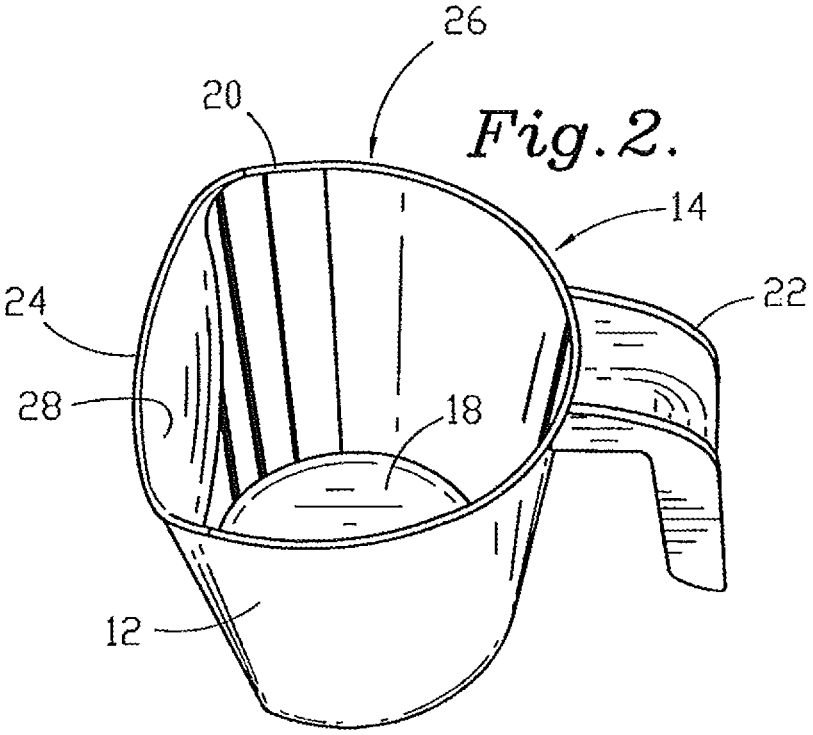
FIG. 2 is a top and interior perspective view of the embodiment of FIG. 1 and showing the flexible wall opposite the handle.
Figure 3:
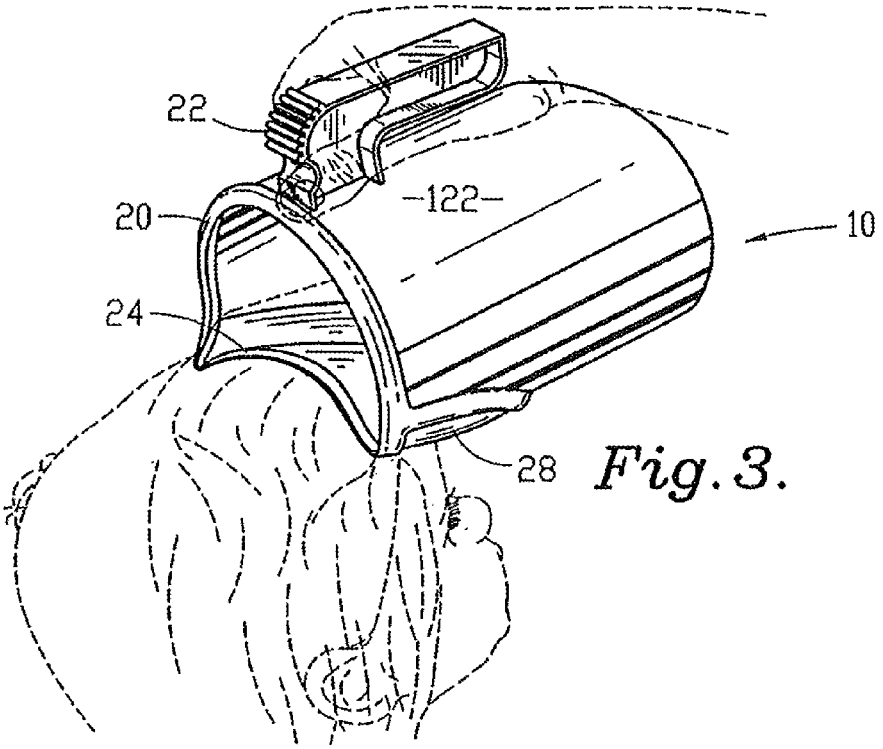
FIG. 3 shows the application of an embodiment of the invention to the head of a child to allow water to flow over the child's hair and back of the head while the flexible panel and flexible rim conform to the shape of the child's head and prevents water from flowing down the front of the child's head and into the child's eyes and face.

Referring now to FIG. 1, an embodiment of the inventive container 10 is shown which is comprised of generally continuous side wall 12 which can be of any convenient shape, spanning shapes from square to circular to polygonal. Continuous side wall 12 terminates at either end in upper side wall end 14, and lower side wall end. Continuous side wall 12 can be formed of rubber or plastic or metal or wood or any material which will serve to hold a fluid within continuous side wall 12. Connected to a lower side wall end 16 is bottom or bottom panel 18 (FIG. 2) which serves to close lower side wall end 16 thereby allowing a fluid to be held within continuous side wall 12 and to bottom 18. It will be appreciated that, depending on the material used for the construction of side wall 12, bottom 18 could be constructed with the forming of side wall 12 thus forming a unitary construction of side wall 12 and bottom 18. As shown in FIG. 1, upper side wall end 14, depending on the material used for the construction of side wall 12, can form in and of itself a side wall rim 20, or an additional structure 20 (FIG. 3) can be attached to upper side wall end 14 to form a discreet side wall rim 20 (FIG. 3). Generally, side wall rim 20 will take the shape of upper side wall end 14, however, alternatively, decorative materials could be used to modify the shaping of side wall rim 20. For further convenience, and depending on the size of container 10, a handle 22 can be attached to side wall 12 to assist in the manipulation of container 10.

Side wall rim 20, in a preferred embodiment is comprised of side wall portion 24, which is a generally flat portion of side wall rim 20, and which may, therefore, differ, generally, in its shape as compared to the remainder of side wall rim 12 and side wall 20. For example, if side wall 12, in its construction, comprises a cylindrical container, then side wall rim 20 will be comprised of a generally circular side wall rim portion 26 and a generally flat side wall rim portion or side wall segment or rim segment 24. The utility and benefits of generally flat rim segment 24 will be described hereinafter. In a preferred embodiment, and in the vicinity of generally flat side wall rim portion 24, is flexible panel 28 which extends from side wall 12 toward generally flat side wall rim segment 24 to connect side wall 12 with rim segment 24. It will be appreciated by those skilled in the art that flexible panel 28 and rim segment 24 can be comprised of the to same materials or of different materials depending on the choice of construction. For example, flexible panel 28 may be thin flexible plastic, or a flexible rubber panel, or a waterproof canvas which is attached to side wall 12 and which extends upwardly toward upper side wall end 14 to connect with or form side wall rim segment 24. In such a construction, rim segment 24 could be of a different material which connects with flexible panel 28 or, for example, if a waterproof canvas were used, the canvas could be wrapped over a flexible cord or wire which would form rim segment 24. Therefore, it will be appreciated by those skilled in the art that one of the objects of a preferred embodiment of the present invention is to provide a flexible, shapeable wall segment 30 of either side wall 12 or rim 20, or both rim 20 and side wall 12 which can conform to the shape of an object against which this flexible portion of container 10 is pressed.

Figure 4:
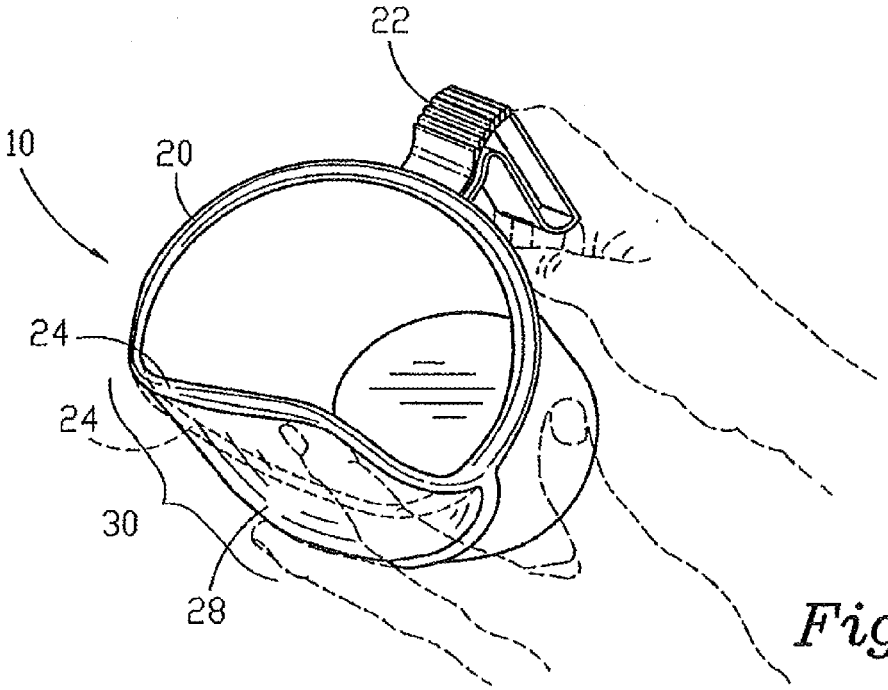
FIG. 4 shows the embodiment of FIG. 4 having a flexible panel and flexible rim and showing the panel and rim in a depressed position and showing the panel and rim in phantom lines in a relaxed or undepressed position.

Referring now to FIG. 4, the flexibility and construction of the novel flexible side wall portion and rim portion of container 10 will be further described. As is shown in FIG. 4, flexible panel 28 and rim segment 24 are deformable and can be pressed inwardly from the position shown in phantom lines and toward the interior of container 10. The benefits of this flexibility or malleability of flexible panel 28 and rim segment 24 are that the pouring portion of side wall rim 20, which is generally rim segment 24, can be formed, by compression of container 10 against the object on which fluid is to be poured, to the shape of the object which is to receive the fluid which is within container 10. Referring to both FIGS. 3 and 4, it is shown that flexible panel 28 and side wall rim 24 are capable of deformation inwardly. This feature of container 10 allows container 10 to be placed against an object, in this case, the forehead of a child (FIG. 3) to have flexible panel 28 and side wall rim 24 registerably mate with the head of the child to provide a wide pouring spout and wide volume of fluid therefor which can be evacuated from container 10 and poured onto the head of the child to rinse the hair of the child.

It will further be appreciated that it is the flexible character of panel 28 and side wall rim 24 which allow for the registerable mating of the flexible portion of container 10. Flexible wall portion 30 (FIGS. 1 and 4), made up of flexible panel 28 and side wall rim segment 24, conforms to the shape of the object or, in this case, the head of a child onto which fluid is to be poured from container 10, and thus, reducing or preventing the flow of fluid from container 10 and back under side wall rim 24 and panel 28. This benefit is particularly useful with respect to rinsing shampoo or other hair products from the hair of a child. The prevention of rinse fluid from draining underneath the side wall rim of a container to allow the rinse fluids and shampoo to run down the forehead of a child and into the eyes, nose and mouth prevent the unpleasantness of eyes stinging from the shampoo or other product being rinsed from the child's hair. The construction of flexible wall portion 30 can be continuous between panel 28 and rim segment 24 (FIGS. 1 and 2), or flex panel 28 and rim 24 can be separate constructions which join together FIGS. 3 and 4 to provide a flexible rim segment and side wall portion of container 10. For example, flex panel 28 could be formed from a flexible plastic, or a rubber panel or a waterproof cloth panel which connects with a rim segment 24 which is constructed of a flexible wire covered with sponge or covered with rubber or covered with a waterproof fabric. Alternatively, rim segment 24 could be a piece of rubber or piece of sponge which is placed across a rigid portion of side wall 12 which comprises any portion of side wall rim 20. In this construction, only the malleable or flexible rim segment 24 would conform to the shape of the object against which container 10 is pressed. In this embodiment only rim segment 24 is flexible and no flex panel is provided to connect between side wall 12 and rim segment 24. In such an embodiment, side wall 12 continues to join rim segment 24, and the flexible, malleable aspect is contained solely within side wall rim segment 24.

As has been described, the benefits of the present invention are achieved by a container having a flexible side wall segment and/or a flexible rim segment which allow close contact of the container with an object or the head of a child to prevent the wash back or flow of fluid from the container underneath the rim and side wall of the container, and which, thereby when rinsing the head of a child, prevents soapy water from getting into the eyes and face of the child. Further, the present invention, as previously described, allows the flexible portion of the container to mold to a shape against which it is pressed and to allow large volumes of fluid to be passed from the container onto the object by virtue of the generally flat rim segment which may contain a rubber cushion to ease contact with the head. It will further be appreciated that in an a alternative embodiment of this invention, the side wall could be provided with a concave portion which would generally conform to the curvature of a child's head and the side wall would be provided with a malleable rim segment on the concave side wall portion. The malleable rim segment portion would more closely register with the child's head than with the concave side wall segment thereby directing the flow of water over the child's head and preventing the flow of water back underneath the side wall of the container.

Figure 6:
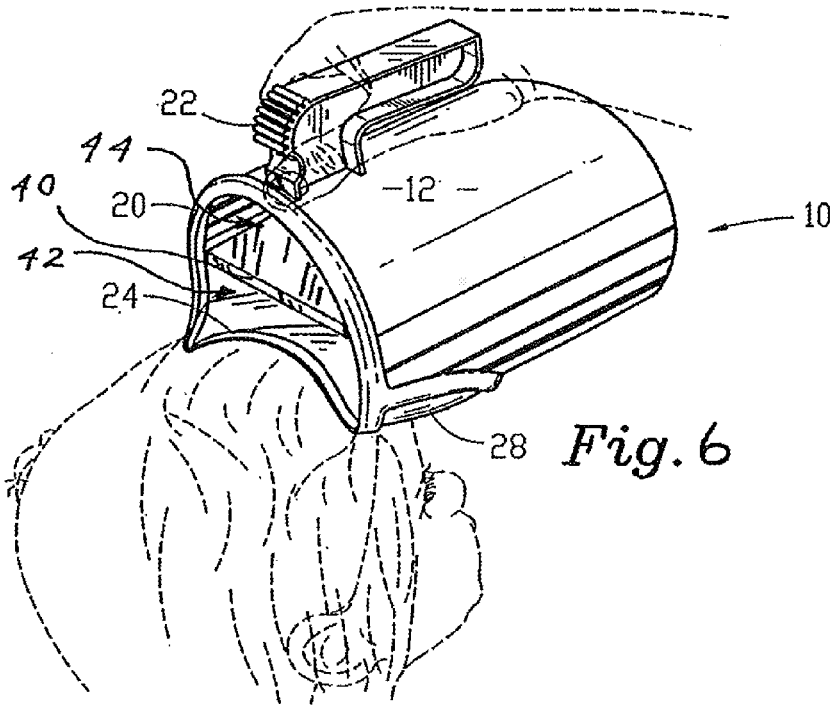
FIG. 6 shows the embodiment of FIG. 5 applied to the head of a child to allow water to flow over the child's hair and back of the head and having a divider panel within the container to provide a second source of fluid flow that is not affected by the deflection of the flexible panel.
Figure 5:
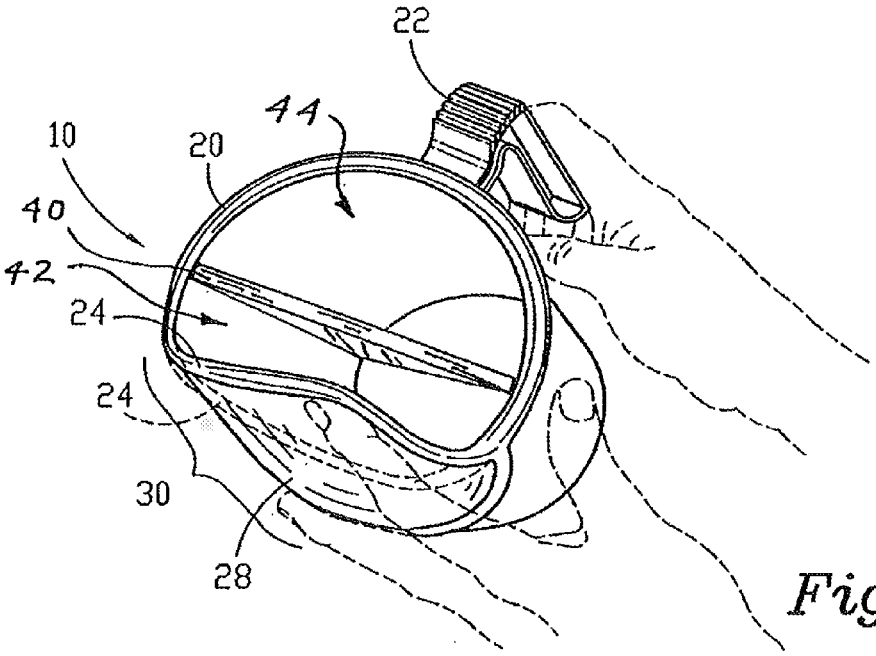
FIG. 5 shows an embodiment of the invention having a divider placed within the container to provide a second source of fluid flow.

Referring now to FIG. 5, an alternative embodiment of the present invention is shown wherein a divider panel 40 is formed or inserted within container 10 to divide the interior space defined by continuous 12 into a first compartment 42 and a second compartment 44. As has previously been described, an important aspect of the present invention is the provision of a flexible panel 28, or, alternatively, a malleable rim segment 24 which can conform to the shape of the objects against which container 10 is pressed. It will be appreciated that as flexible panel 28 is depressed inwardly to conform to the shape of the object against which container 10 is pressed that there can be a tendency for the water contained in container 10 to be diverted to one side or the other (i.e., the lower outside edges of flexible panel 28) as the middle portion of flex panel 28 is depressed inwardly, and therefore, becomes a high point which can shed water towards the outside edges as shown in FIG. 3. The alternative embodiment shown in FIGS. 5 and 6 provides a means for providing a secondary water supply which is captured within the second compartment 44. As container 10 is pressed against an object and tipped upwardly as is shown in FIG. 6, water contained in second compartment 44 will flow along divider panel 40 and will flow outwardly evenly across the width of divider panel 40 and onto the object against which container 10 is depressed. At the same time, water contained within first compartment 42 will, depending upon the degree of inward depression formed in flex panel 28 by the pressure flex panel 28 against an object, will tend to divert a greater portion of the fluid contained in first compartment 42 toward the outer, lower edges of flex panel 28 and away from the higher portion of flex panel 28 presented by the compression of flex panel 28 against an object. In this manner, the alternate embodiment of the present invention containing divider panel 40 provides increase flow of fluid across the area of the object that is causing the greater deflection of flex panel 28 by providing two separate sources of fluid. The first source of fluid being contained in first compartment 42 which flows outwardly across flex panel 28 and is susceptible to a degree of diversion depending upon the degree of flexing of flex panel 28 and a second component of fluid contained in second compartment 44 which will flow independently of the amount of depression or flexion of flex panel 28 as it flows outwardly from second compartment 44 across the surface of divider panel 40 to flow onto the object against which container 10 is compressed.

It will be appreciated by those skilled in the art that divider panel 40 may be either fixed in place within container 10, or panel 40 may be insertable and removable within container 10 through the use of a frictional fit of divider panel 40 within container 10, or by the use of support tracks formed into side wall 12 and/or bottom 18 of container 10.

Figure 7:
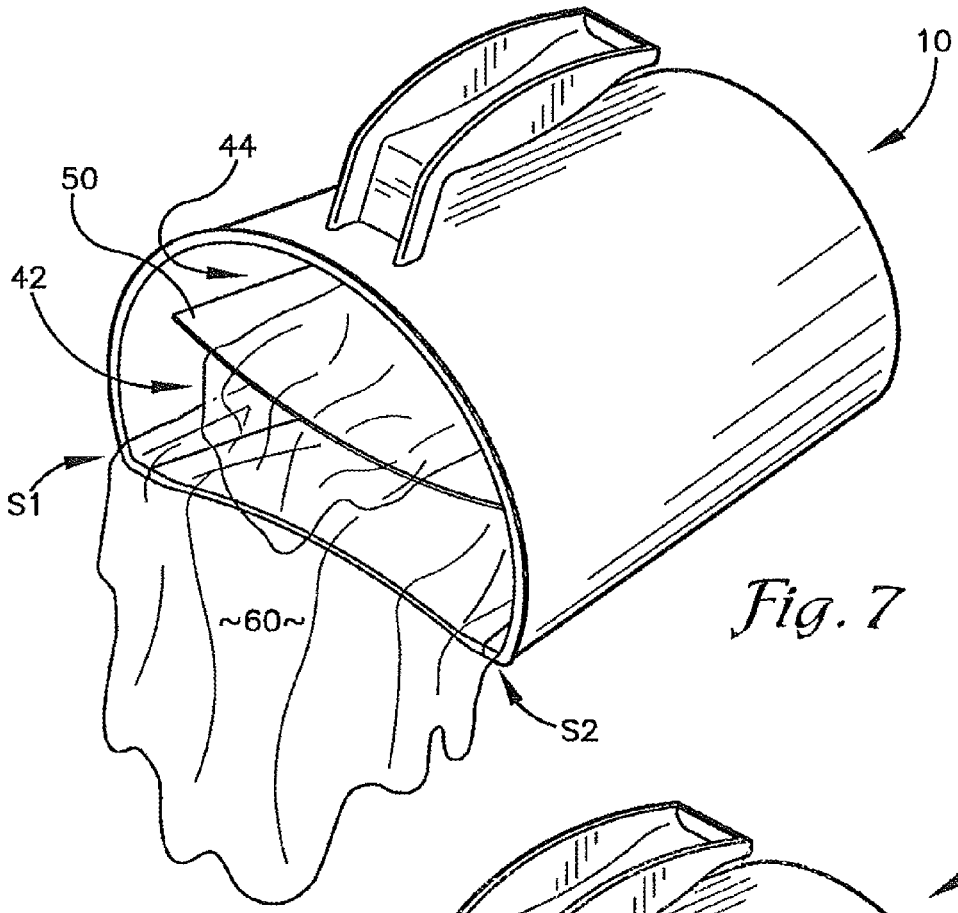
FIG. 7 shows an alternate embodiment having a curved divider panel 50 which separates container 10 into first and second fluid holding compartments.

Referring now to FIG. 7, an alternate embodiment of the present invention is shown in which container 10 is provided with a generally curved divider panel 50 which separates container 10 into two fluid holding compartments. A first fluid holding compartment 44 and a second fluid holding compartment 42 are separated by curved divider panel 50. It will be appreciated that first compartment 44 and second compartment 42 typically will both hold the same fluid although different fluids might be placed into each. As shown in the embodiment of FIG. 7, curved divider panel 50 is provided with a curvature in which the panel 50 is curved toward flexible panel 28. This curvature of panel 50 provides a fluid directing feature to the shape of curved divider panel 50. The curvature of panel 50 generally directs the flow of water held within second compartment 44 into the center of curved divider panel 50 as it flows out of container 10 and onto the head of a child or other person against whom flexible panel 28 has been pressed. It will be appreciated that the curvature of panel 50 thereby directs the fluid contained in second compartment 44 generally onto the center of the head of the child and avoids even distribution of the water across the width of curved divider panel 50 as the water is being poured out of second compartment 44. The benefit of the curvature of divider panel 50 is that the majority of the rinse fluid contained within compartment 44 is placed onto the center of the child's head and is not wasted by pouring down either side of the child's head nor does it contribute to an increased probability of shampoo suds being washed into the eyes of the child. As previously described for other embodiments, flexible panel 28 of the embodiment shown in FIG. 7 becomes inwardly flexed toward curved divider panel 50 when container 10 is pressed against the forehead of a child while rinsing shampoo from the child's head. It also will be appreciated that during the course of flexing, flexible panel 28, as it is pressed against the head of a child, a certain amount of fluid will be directed to the lower portions of flexible panel 28 which are designated in FIG. 7 as S1 and S2. By providing curvature to curved panel 50, to increase the water flow towards the center of the child's head, curve divider panel 50 helps compensate for any increase in water flow from first compartment 42 which is directed to the areas S1, S2 due to the upward or inward flexing of flexible panel 28 as it is pressed against the forehead of a child.

Figure 8:
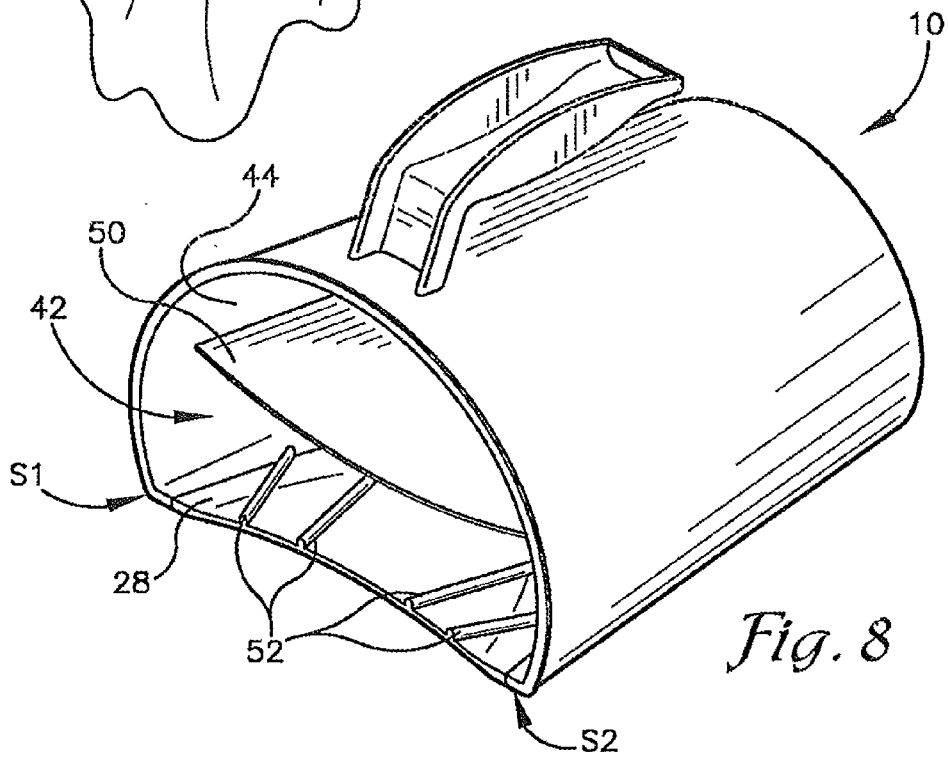
FIG. 8 shows an alternate embodiment of the embodiment of FIG. 7 showing fluid directing ridges 52 provided on the inside surface of flexible panel 28.

Referring now to FIG. 8, an embodiment is shown in which fluid directing ridges 52 are included on the inside surface of flexible panel 28. Ridges 52 are included to assist in reducing the amount of water which flows out the side areas S1, S2 of flexible panel 28 as it flexed against the head of a child. It will be appreciated that ridges 52 are, in a preferred embodiment, molded of the same material which flexible panel 28 is constructed. Alternatively, ridges 52 could be separately constructed and affixed to flexible panel 28, however, it is desirable that ridges 52 do not obstruct the flexibility of panel 28 as it should be readily shapeable or moldable against the contours of the forehead of a child. It will be appreciated by those skilled in the art that fluid directing ridges 52 will assist in reducing the amount of fluid which is directed along a path at either side of flexible panel 28 as indicated by arrows S1 and S2 of FIG. 8. In this manner, ridges 52, in conjunction with the curvature of panel 50, will generally increase the amount of water flow from compartments 42, 44 which is directed towards the center of the head of a child.

Figure 9:
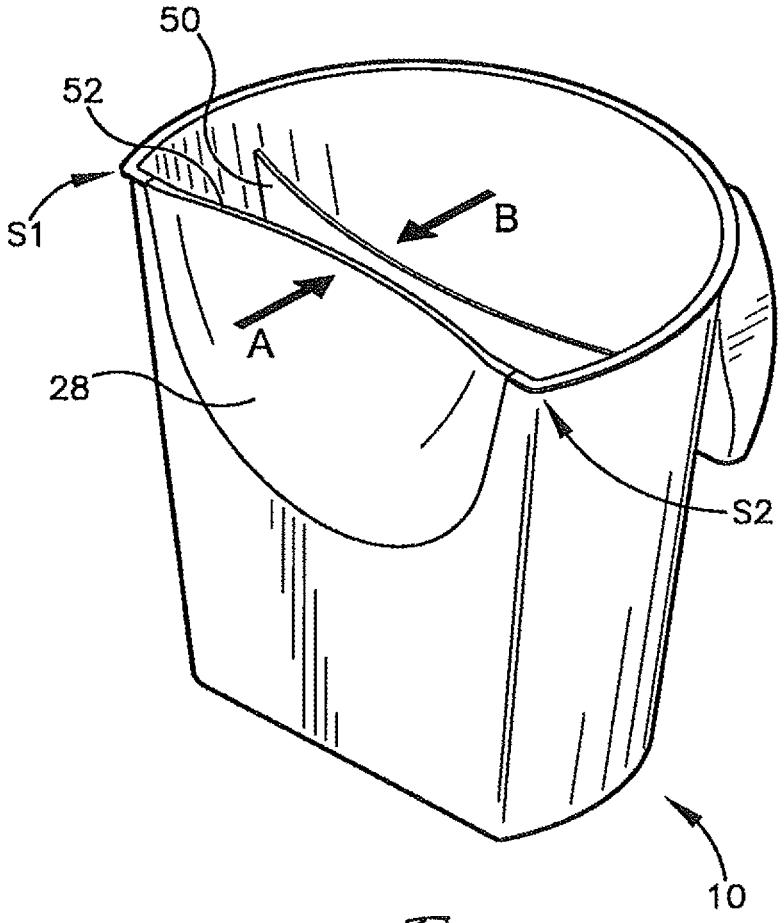
FIG. 9 is a top front and right side perspective view of the embodiments of FIGS. 7 and 8 showing the flexing of flexible panel 28 inwardly along the direction indicated by Arrow A and toward curved divider panel 50 which is curved toward flexible panel 28 and in the direction indicated by Arrow B.

Referring now to FIG. 9, the exterior of the embodiments of FIGS. 7 and 8 is shown with flexible panel 28 being presented slightly inwardly flexed along the direction indicated by Arrow A, and with Arrow B. FIG. 9 shows the general direction of the depression or curvature provided in curved divider panel 50. The embodiment of FIG. 9 shows flexible panel 28 as being directly connected or molded onto container sidewall 12 with the upper edge 52 of flexible panel 28 providing the flexible rim segment 24 of the sidewall rim 20 of sidewall 12.

Figure 10:
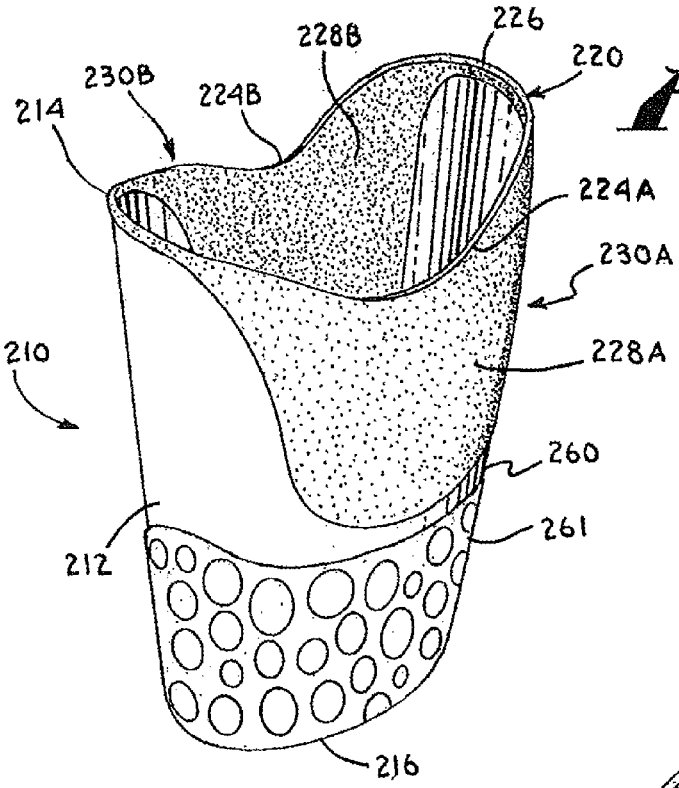
FIG. 10 is a top and side perspective view of a pitcher of an alternate embodiment of the invention showing flexible panels located on a side wall of the pitcher and with a top head engaging edge on both sides of the pitcher and also with a non-slip grip on a lower portion of the pitcher.
Figure 11:
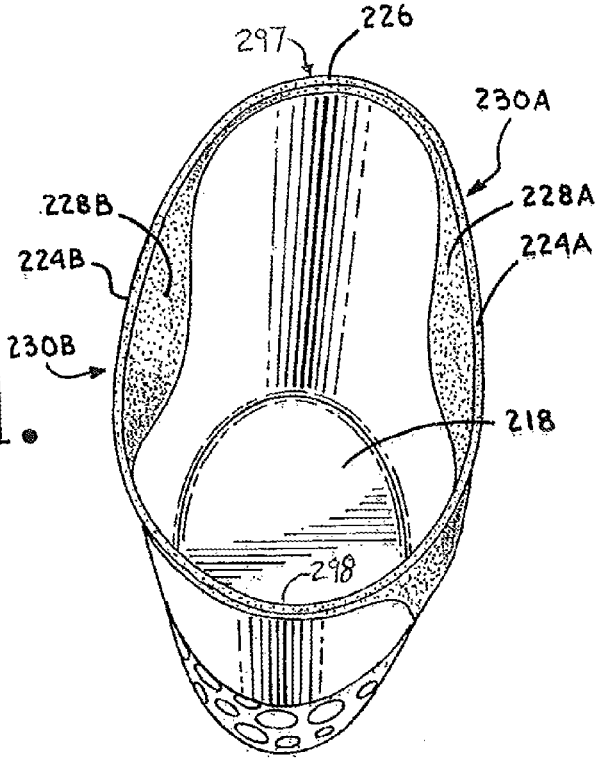
FIG. 11 is a perspective view of the embodiment of FIG. 10 showing the flexible walls and an overall interior.

Referring now to FIGS. 10 and 11, a further embodiment of an inventive container or pitcher 210 is shown which generally comprises an upstanding continuous side wall 212 which can be of a convenient shape as noted below, spanning shapes from oval to polygonal, but is depicted in FIGS. 10-14 as oval or oblong shaped. The side wall 212 terminates at a top and a bottom thereof in upper side wall end or edge 214 and lower side wall end 216 respectively. The side wall 212 is formed of rubber or plastic or metal or wood or any material which will serve to hold a fluid within continuous side wall 212. Shown in FIGS. 10-14, the side wall 212 is separated into major regions 260 and 261 and minor segments 228 A and B. The side wall regions 260 and 261 are preferably constructed of a similar or identical material. While being somewhat flexible and resiliently resistant to breakage, the regions 260 and 261 are relatively stiff so as to hold shape both when sitting and when being held in the hand of a user. Still further, the regions 260 and 261 are sufficiently stiff to hold shape whether the pitcher 210 is filled with water or empty.

Figure 12:
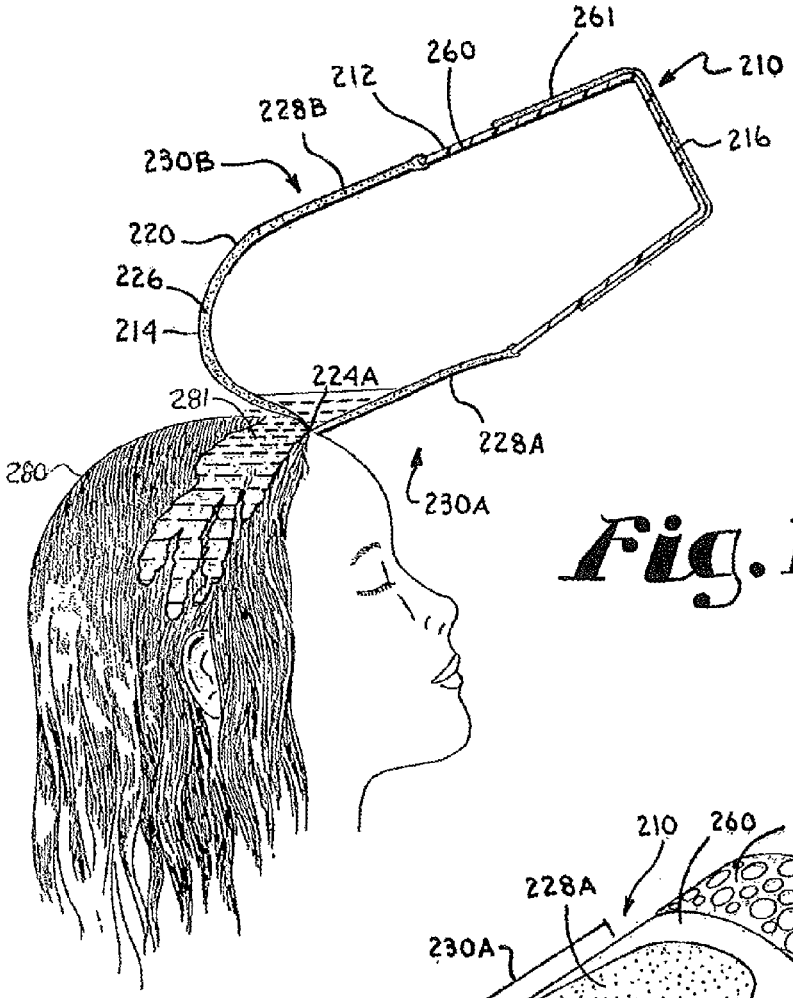
FIG. 12 is a cross-sectional view of the pitcher of FIG. 10 being used to rinse soap from the head of a large child by allowing water to flow over the child's hair and back of the head while the flexible panel with a larger head engaging curvature conforms to the shape of the child's head and resists the flow of water down the front of the child's head and into the child's eyes and face.

The sections 228 A and B are on opposite upper sides of the pitcher 210. The sections 228 A and B extend downward from the top edge 214 to approximately the middle of the side wall 212, although the overall vertical length can be varied somewhat for the purpose described below. The sections 228 A and B are continuous with the region 260, but constructed of a softer, less stiff and more pliable material that is more easily deformed by manual pressure than the regions 260 and 261. The purpose of each of the segments 228 A and B is to mate with the head of a person and to conform to the shape of the head of the person as water is poured on the head. In particular, the section 228A is sized and shaped to conform to the shape of a head 280 of a larger child, as seen in FIG. 12, as water 281 is poured from the pitcher 210 onto the head 280 to rinse soap from the hair of the head 280. The upper edge 214 associated with the section 228*a* is depressed downwardly from sides thereof to a center thereof to form a vertically concave portion 224A which can best be seen in FIG. 15. The concave portion 224A has a curvature that is sized and shaped to conform to the larger child's head 280, but is sufficiently flexible to somewhat sealably mate with a range of larger children's heads.

Figure 13:
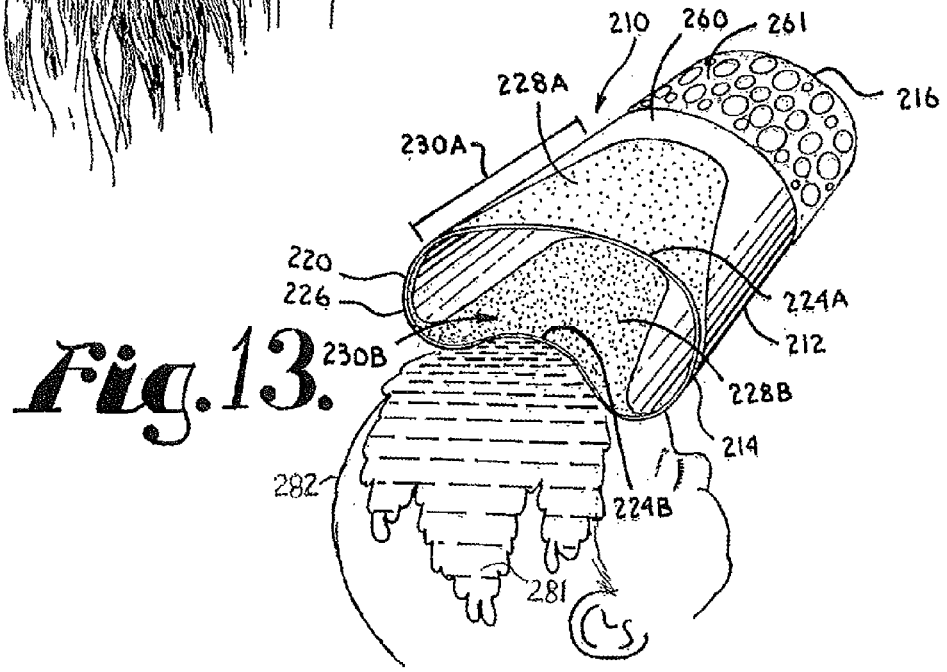
FIG. 13 is a perspective view of the pitcher of FIG. 10 showing another application of an embodiment of the invention in FIG. 10 to the head of a small child or baby to allow water to flow over the baby's hair and back of the head while a flexible panel with a curvature shaped for a smaller head conforms to the shape of the baby's head and prevents water from flowing down the front of the baby's head and into the baby's eyes and face.

The section 228B is similar to section 228A and integrates with the region 260 to form the sealed water holding pitcher 210. The difference between section 228B and A is that section 228B has a smaller upper concave portion. Section 224B is sized and shaped to sealably mate with a smaller child or baby's head 282, as seen in FIG. 13. When the pitcher 210 is positioned so that the sections 228A or B are against the head 280 or 282 respectively of a child to be rinsed, slight pressure by the user's hand 294 deforms the appropriate section 224A or B to wrap or mold about the forehead of the respective head 280 or 281 to form a similar shape to the head 280 or 281 at the location of contact and thereby better control the flow water 291 onto the head 290 or 292 in an area needing rinsing.

Region 261 sealably mates with the region 260 at a lower portion thereof and is preferably continuous and constructed of the same basic material. However, the region 261 is surface covered with a plurality of separate grip spots 295. The grip spots 295 are constructed of a material that is less slippery when wet than the remainder of the region 261, thereby allowing the user to better hold and control the pitcher 210. The grip spots 295 are illustrated as discontinuous circular areas of various sizes; however, it is foreseen that the grip spots 295 could be of the same size or of different shapes or even continuous bands or stripes to facilitate gripping.

The pitcher 210 is substantially wider from side to side than from front to rear, as seen in FIG. 11. In particular, the illustrated pitcher 210 is approximately twice as wide from side to side as from front to rear. This has the effect of making end spouts 297 and 298 that concentrate fluid 281 flowing from the pitcher 210 into a thinner and heavier stream when the pitcher 210 is poured, as shown in FIG. 14. This allows a user to concentrate a heavy flow of fluid 281 when desired as compared to the wider streams that flow across the sections 228*a* and *b* when fluid 281 is poured from either of the later.

The pitcher 210 also includes a bottom panel 218 that is sealably joined to the region 261 at the bottom wall end 216 of the side wall 212. The illustrated pitcher 210 is handless, but it is foreseen that a handle could be utilized on one of the sides, so as not to interfere with mating of the sections 228A and B with a person's head.

The sections 224A and B form an upper rim 220 with the region 260 which is continuous and sealed around the top of the pitcher 210. It will be appreciated by those skilled in the art that flexible panels 228A and 228B and rim segment 224A and 224B can be comprised of the to same materials or of different materials depending on the choice of construction. For example, flexible panel 228A may be thin flexible plastic, or a flexible rubber panel, or a waterproof canvas which is attached to side wall 212 and which extends upwardly toward upper side wall end 214 to connect with or form side wall segment 224A. In such a construction, segment 224A or 224B could be of a different material which connects with flexible panels 228A and 228B or, for example, if a waterproof canvas were used, the canvas could be wrapped over a flexible cord or wire which would form segment 224A and 224B. Therefore, it will be appreciated by those skilled in the art that one of the objects of this embodiment of the invention is to provide a flexible, shapeable segments 230A and 230B of either side wall 212 or rim 220, or both can conform to the shape of an object against which this flexible portion of container 210 is pressed. The construction of flexible wall portions 230A and 230B made very similarly as described above.

In use, as is shown in FIG. 12, flexible panel 228A and segment 224A of the flexible wall portion 230A are deformable and can be pressed inwardly from the position shown in FIG. 10 and toward the interior of container 210. The benefits of this flexibility or malleability of flexible panel 228A and segment 224A are that the pouring portion of side wall 220, which is generally segment 224A, can be formed, by compression of container 210 against the object on which fluid is to be poured, to the shape of the object which is to receive the fluid which is within container 210. The concavity feature of segments 224A and 224B of container 210 allows the container 210 to be fitted against the forehead of a child and to have flexible panel 228A and side wall 224A registerably mate with the head 280 of the child to provide a wide pouring spout and wide volume of fluid therefor which can be evacuated from container 210 and poured onto the head 280 of the child to rinse the hair of the child.

As shown in FIG. 13, container 210 to be placed against the forehead of a child such that the smaller concavity of flexible panel 228B and section 224B registerably mate with the head 282 of a smaller child or baby than shown in FIG. 12, to provide a wide pouring spout and wide volume of fluid, which can be evacuated from container 210 and poured onto the head of the smaller child to rinse the hair of the smaller child.

Referring to FIG. 14, the pitcher 210 is shown tilted sideways by a hand 294 on the pitchers shorter side rim 220 to pour a heavier and more centralized pour than is produced by pouring along either the flexible wall portions 230A and 230B.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the to accompanying drawings shall be interpreted as illustrative and not meant in a limiting sense.

Having now described the features, discoveries and principles of the invention, the manner in which the inventive container or pitcher is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed and desired to be secured by Letters Patent is as follows:

1. A container comprising:

a) a generally self supporting stiff and continuous side wall terminating in an upper side wall end and a lower side wall end and defining an inward space bounded by the continuous sidewall;

b) a bottom closing the lower side wall end with the upper side wall end being generally open;

c) an upper first inwardly flexible section forming a first portion of the side wall and extending to form a first portion of the upper side wall end with a first vertically concave upper portion; and d) a second inwardly flexible section opposed to the first section and forming a second portion of the side wall and extending to form a second portion of the upper side wall end, the second flexible panel having an upper vertically concave portion that is smaller in size compared to the concave portion of the first flexible panel.

2. The container as claimed in claim 1, including at least one easy grip and non-slip surface located on an exterior of the sidewall of the container.

3. The container as claimed in claim 1, including a divider spanning an interior and contacting with the bottom to define first and second fluid-holding regions of the interior, the divider being oriented generally parallel to the flexible panel, the first and second fluid-holding portions operating to approximately concurrently pour a fluid onto a head pressed against the flexing panel.

4. The container as claimed in claim 1, further comprising a rim attached to said upper side wall end.

5. The container as claimed in claim 4, wherein the rim is comprised of rubber.

6. A container comprising:

a) a generally continuous sidewall terminating in an upper sidewall end and a lower sidewall end and defining an inward fluid holding space bounded by the sidewall, the sidewall having an upper flexible section thereof that defines a generally downwardly concave portion and a generally less flexible stiff lower portion joined to the flexible section;

b) a bottom joined to and closing the lower sidewall end with said upper sidewall end being generally open;

c) the flexible section being at least inwardly flexible and extending to form at least a portion of the upper sidewall end, the flexible section facing outwardly and being sized, shaped and sufficiently pliable to matingly mold to the head of a person during use; the flexible section downwardly concave portion being sized and shaped to facilitate mating with the head of the person that is being rinsed by the container; and d) wherein the inwardly flexible section is a first inwardly flexible section forming a first portion of said side wall and extending to form a first portion of said upper side wall end, said flexible section having a generally smooth inward surface for unobstructed fluid flow out of said open upper side wall end, and further including a second opposed inwardly flexible section forming a second portion of the side wall and extending to form a second portion of said upper side wall end, the second flexible section having a generally smooth inward surface for unobstructed fluid flow out of said open upper side wall end and being of a generally smaller size than the first flexible section.

7. A pitcher comprising:

a) a generally continuous sidewall having an upper sidewall end and a lower sidewall end and defining an inward fluid holding space bounded by the sidewall, the sidewall having a stiff lower region and an upper flexible section that defines a generally vertically concave upper portion and a comparatively less flexible region joined on either end to the flexible section;

b) a bottom attached to the lower sidewall end with the upper sidewall end being generally open;

c) an upper rim associated with the upper sidewall end;

d) a portion of the rim being sufficiently inwardly flexible and including the concave upper portion to generally conform to the shape of a head to which when the rim is pressed against the head;

e) an inwardly flexible and pliable section forming a portion of the sidewall and connecting with said inwardly flexible rim portion, the inwardly flexible section having an outward facing surface that is sized and shaped to matingly mold to the head of a person during use; and f) wherein the inwardly flexible section is a first inwardly flexible section forming a first portion of said side wall and extending to form a first portion of said upper side wall end, and further including a second opposed inwardly flexible section forming a second portion of the side wall and upper side wall end, the second flexible section having a vertical concave portion that is smaller than the vertical concave portion of the first flexible section.

8. A container comprising:

a) a generally rigid continuous side wall having an upper side wall end and a lower side wall end the side wall defining a container body, said side wall having a portion thereof that defines a side wall section, b) a bottom joined to the lower side wall end to define with the upper side wall an inward fluid-holding interior with the upper side wall end being generally open, c) an upper inwardly flexible section having a vertically downward concave upper rim;

d) wherein the inwardly flexible section is a first inwardly flexible section forming a first portion of said side wall and extending to form a first portion of said upper side wall end, and further including a second inwardly flexible panel section opposite the first flexible section forming a second portion of the side wall and extending to form a second portion of said upper side wall end; and e) wherein each of the first and second sections have upper downwardly concave rim portions wherein the concave rim portion of the first section is much greater in vertical depth as compared to the concave portion of the second section.

9. A container comprising:

a) a generally rigid continuous side wall having an upper side wall end and a lower side wall end the side wall defining a container body, said side wall having a portion thereof that defines a generally flexible and flat side wall section, b) a bottom joined to the lower side wall end to define an inward fluid-holding interior with the upper side wall end being generally open, the upper side wall end including a rim on the upper side wall end having a flexible rim segment, c) an inwardly flexible section of at least a portion of said generally flat side wall section and extending to form the flexible rim segment of said inwardly flexible panel, the inwardly flexible panel providing generally unobstructed fluid flow out of the open upper side wall end and the flexible panel generally conforming to the shape of an object pressed against the flexing panel, d) a plurality of grip spots of easily grippable material forming a grippable surface on top an exterior of the rigid continuous side wall positioned to assist a user in gripping the container, e) at least a portion of the side wall is downwardly concave, the concave side wall portion having a rim portion of a flexible material, and f) wherein the inwardly flexible section is a first inwardly flexible section forming a first portion of the side wall and extending to form a first portion of the upper side wall end, the flexible panel further including a second inwardly flexible section opposed to the first flexible section and forming a second portion of the side wall and extending to form a second portion of the upper side wall end, the concave portion of the second flexible section being substantially smaller in depth than that of the first flexible panel.

* * * * *